US010271648B2

(12) United States Patent
Harder et al.

(10) Patent No.: US 10,271,648 B2
(45) Date of Patent: Apr. 30, 2019

(54) CABINET ASSEMBLY HAVING AN ADJUSTMENT MECHANISM

(71) Applicant: NewAge Products, Inc., Vaughan (CA)

(72) Inventors: Mitch Harder, Toronto (CA); Robert Vandenham, North York (CA)

(73) Assignee: NewAge Products, Inc., Vaughan, Ontario (CA)

( * ) Notice: Subject to any disclaimer, the term of this patent is extended or adjusted under 35 U.S.C. 154(b) by 0 days.

(21) Appl. No.: 15/952,963

(22) Filed: Apr. 13, 2018

(65) Prior Publication Data

US 2018/0295988 A1 Oct. 18, 2018

Related U.S. Application Data

(60) Provisional application No. 62/485,445, filed on Apr. 14, 2017.

(51) Int. Cl.
*A47B 88/43* (2017.01)
*A47B 88/407* (2017.01)

(52) U.S. Cl.
CPC ..... *A47B 88/407* (2017.01); *A47B 88/43* (2017.01)

(58) Field of Classification Search
CPC ... A47B 88/407; A47B 88/417; A47B 88/423; A47B 88/427; A47B 2088/4235
See application file for complete search history.

(56) References Cited

U.S. PATENT DOCUMENTS 6,230,903 B1 * 5/2001 Abbott ..... H05K 7/1421 211/190
6,666,340 B2 12/2003 Basinger et al.
6,702,412 B2 3/2004 Dobler et al.
6,736,277 B2 5/2004 Lauchner et al.
7,192,103 B2 3/2007 Hamilton
7,654,625 B2 2/2010 Amann et al.
7,798,582 B2 * 9/2010 Yu ..... A47B 88/43 211/26
9,044,089 B1 6/2015 Sandhu
9,986,828 B2 * 6/2018 Chen ..... A47B 88/407
(Continued)

FOREIGN PATENT DOCUMENTS

EP 421458 B1 9/1993

OTHER PUBLICATIONS

English language translation of EP 0421458 A1, downloaded from espacenet dated Jul. 13, 2018; 23 pages.

*Primary Examiner* — Daniel J Rohrhoff
(74) *Attorney, Agent, or Firm* — Howard & Howard Attorneys PLLC

(57) ABSTRACT

A cabinet assembly includes an adjustment mechanism for adjusting the positioning of a drawer within a cabinet. In particular, the cabinet assembly includes first and second adjustment strips, and third and fourth adjustment strips, coupled adjacent to a respective first and second side of the cabinet, with each adjustment strips including a plurality of slots aligned vertically. The cabinet assembly further includes a first track mount assembly adjustably mounted to each of the first and second adjustment strips along a first side of the cabinet, and a second track mount assembly adjustably mounted to each of the third and fourth adjustment strips along a second side of the cabinet. A drawer, including first and second drawer slide assemblies, is slidingly engaged to the first and second track mount assemblies.

20 Claims, 10 Drawing Sheets

(56) References Cited

U.S. PATENT DOCUMENTS

| | | | | |
|---|---|---|---|---|
| 10,070,555 | B1 * | 9/2018 | Chen | H05K 7/1489 |
| 2002/0074915 | A1 | 6/2002 | Shih | |
| 2012/0017414 | A1 * | 1/2012 | Cerniglia | A47B 88/43 29/428 |
| 2017/0181543 | A1 * | 6/2017 | Chen | A47B 96/068 |
| 2018/0220797 | A1 * | 8/2018 | Chen | A47B 88/423 |

* cited by examiner

CABINET ASSEMBLY HAVING AN ADJUSTMENT MECHANISM

CROSS-REFERENCE TO RELATED APPLICATIONS

The present invention claims priority to U.S. provisional application 62/485,445, filed Apr. 14, 2017, entitled "Cabinet Assembly Having an Adjustment Mechanism", the disclosure of which is herein incorporated by reference.

FIELD OF THE DISCLOSURE

The present disclosure relates generally to a cabinet assembly having an adjustment mechanism, and more particularly to a cabinet assembly having adjustable track mount assemblies coupled to adjustment strips for adjusting the relative positioning, in terms of height, of a drawer within the cavity of a cabinet.

DESCRIPTION OF RELATED ART

Cabinet assemblies known in the art and generally include a cabinet and drawers that are slidably coupled within a cavity of the cabinet and extendible between an open and closed position.

Typically, the drawers are supported within the cavity of the cabinet for slidable extension and retraction by means of elongated guide members which are fixedly attached (i.e., fastened or mounted or otherwise secured) to the opposite sides of the cabinet within the cavity and the cooperating elongated slide members secured to opposite sides of the drawer. The relative positioning of the drawer within the cavity of the cabinet, in terms of height, corresponds to the relative location of the secured elongated guide members along the sides of the cabinet within the cavity. Accordingly, to change the relative positioning of the drawer (i.e., change the height of the drawer within the cavity of the cabinet), one must change the relative positioning of the secured elongated guide members along the sides of the cabinet. To accomplish this, after removing the drawer by disengaging the elongated slide members of the drawer from the elongated guide member, the elongated guide members must first be detached (i.e., unfastened or unmounted or otherwise unsecured) from the opposite sides of the cabinet, moved to a new desired position, and reattached to the opposite sides of the cabinet. The elongated slide members of the drawer are then reengaged to the elongated guide members such that the drawer is at the new desired height within the cavity of the cabinet. This process of detaching and reattaching the elongated guide members can be time consuming and burdensome.

The present disclosure provides a cabinet assembly which has a simpler adjustment mechanism for quickly and easily changing the relative positioning of a drawer within the cavity of the cabinet.

SUMMARY OF THE INVENTION

One embodiment of a cabinet assembly is provided that includes a first side and an opposing second side. In further embodiments, the cabinet assembly also includes a back, a top and a bottom, and together with the first and second sides defines a cavity having an opening. The cabinet assembly also includes first and second adjustment strips coupled adjacent to the first side of the cabinet as well as third and fourth adjustment strips coupled adjacent to the second side of the cabinet, with each the respective adjustment strips including a plurality of slots aligned vertically. The cabinet assembly further includes a first track mount assembly adjustably mounted to each of the first and second adjustment strips along the first side of the cabinet, and a second track mount assembly adjustably mounted to each of the third and fourth adjustment strips along the second side of the cabinet.

The first and second track mount assemblies, respectively, include a housing having a rearward housing end and a forward housing end and at least one fixed locater extending from the forward housing end, wherein each one of the at least one fixed locaters is coupled within a respective one of the plurality of slots of one of the respective adjustment strips. The first and second track mount assemblies also, respectively, include an adjustment mechanism coupled to the housing at the rearward housing end that includes a moveable insert having at least one locater coupled thereto. The adjustment mechanism is moveable relative to the rearward housing end between an engaged position and an adjustment position. The adjustment mechanism also includes a biasing device coupled to the moveable insert that biases the moveable insert in a biasing direction such that the at least one insert extends beyond the rearward housing end when the moveable insert is in the engaged position. Each of the at least one locaters is coupled within a respective one of the plurality of slots of another one of the respective adjustment strips when the respective moveable insert is in the engaged position.

The cabinet assembly, in a further related embodiment, also includes a drawer having a right side and a left side, a first drawer slide assembly coupled to the right side of the drawer and also coupled to the first track mount assembly, and a second drawer slide assembly coupled to the left side of the drawer and also coupled to the second track mount assembly. The drawer is configured to be slidably engaged with the first track mount assembly through the first drawer slide assembly and to be slidably engaged with the second mount assembly through the second drawer slide assembly when the drawer is coupled to the first and second track mount assembly. In embodiments defining a cavity, the drawer is configured to be slidably engaged with the first track mount assembly through the first drawer slide assembly and to be slidably engaged with the second mount assembly through the second drawer slide assembly when the drawer is coupled to the first and second track mount assembly within the cavity and is moved between a closed position and an extended position. The closed position is defined wherein the entire drawer is positioned within the cavity and the extended position defined wherein a portion of the drawer is positioned outside the cavity.

The cabinet assembly overcomes the disadvantages in the related art related to the detaching, moving and reattaching of elongated guide members to the sides of the cabinets in order to adjust the height of a drawer within the cabinet, and in certain embodiments within the cavity of the cabinet. Specifically, in accordance with the present disclosure, the track mount assemblies can easily be coupled to, and uncoupled from, the respective adjustment strips without requiring the detachment of the adjustment strips from the respective sides of the cabinet in order to change the relative location of the respective drawer within the cabinet. In this way, the initial positioning, and repositioning, of the drawers within the cabinet at a desired height can quickly and easily be accomplished.

DETAILED DESCRIPTION

Figure 1:
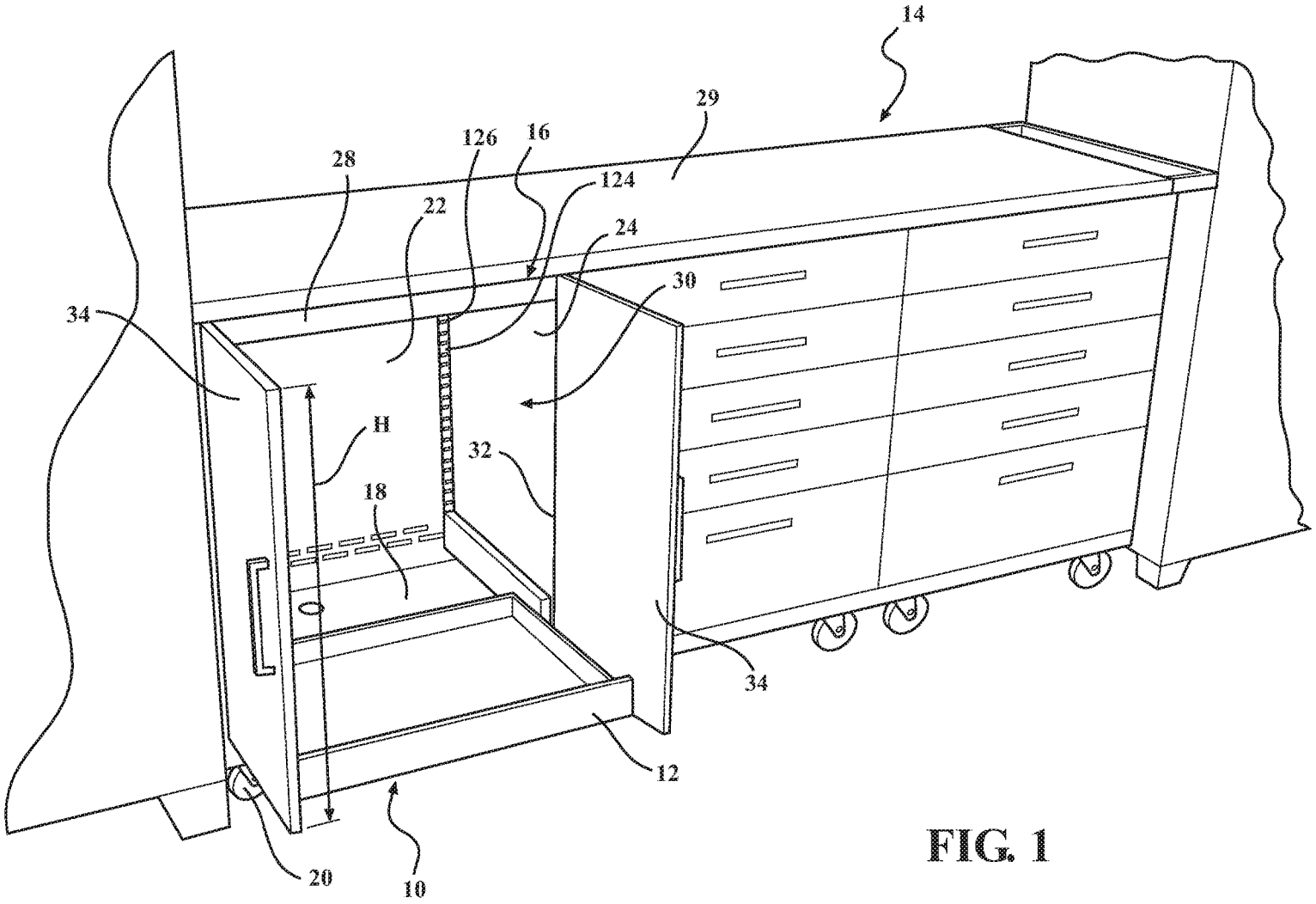
FIG. 1 is a perspective view illustrating a cabinet system including a cabinet assembly including an adjustable pull-out drawer.

Referring now to the figures, wherein like numerals indicate corresponding parts throughout the several views, embodiments of a cabinet assembly 10 including a drawer 12 are shown throughout the figures and described in detail below. The cabinet assembly 10 has an adjustment mechanism 11 for enabling an operator to adjust a height of the drawer 12. As shown in FIG. 1, the cabinet assembly 10 may be one of a plurality of cabinet assemblies of a cabinet system 14. The cabinet system 14 may be used anywhere, such as in a garage, a shed, a warehouse, or any designated work room or area of any type of residential or commercial property.

The cabinet assembly 10 may include feet, wheels, and/or the like such that the cabinet assembly 10 can rest or be positioned against a floor of the garage, workroom, etc. As shown in FIG. 1, the cabinet assembly 10 includes a cabinet 16 having a bottom 18 and a plurality of wheels 20 coupled to the bottom 18. The wheels 20 allow the cabinet assembly 10 to be moved from one position on the floor to another. Alternatively, the cabinet assembly 10 could be mounted to a wall utilizing suitable mounting fasteners and/or the like.

In one embodiment, the cabinet 16 of the cabinet assembly 10 has a back 22, opposing sides 24, 26, the bottom 18, and a top 28. The cabinet 16 further has a height H extending from the bottom 18 to the top 28. In an embodiment, a worktop 29 is positioned on the top 28 of the cabinet 16. The worktop 29 may be formed from any suitable worktop material, such as various forms and/or compositions of wood. The worktop 29 may cover just the cabinet assembly 10, or may extend over a plurality of cabinets of the cabinet system 14 such as shown in FIG. 1.

The back 22, the sides 24, 26, the bottom 18, and the top 28 of the cabinet 16 define a cavity 30 having an opening 32, and the cabinet 16 may further include doors 34 for covering the opening 32. A drawer(s) 12 is disposed within the cavity 30, and is accessible through the opening 32 of the cavity 30. In an alternative embodiment, the drawer 12 may have a drawer face, with the drawer face covering at least a portion of the opening 32 of the cavity 30. In this alternative embodiment, cabinet doors 34 may not be required.

In an embodiment, the cabinet assembly 10 includes at least one drawer 12, and the at least one drawer 12 may be of the pull-out style. That is, the drawer 12 is adapted to slide between a closed position (where the entire drawer 12 is disposed within the cavity 30 of the cabinet 16) and an extended position (where at least a portion of the drawer 12 is positioned outside of the cavity 30 of the cabinet 16, as shown in FIG. 1). The drawer 12 may have any suitable drawer configuration, including any suitable depth, width, and/or height. Alternatively, the drawer 12 could be configured as a shelf of the pull-out style. In yet another alternative embodiment, the cabinet 16 may include at least one drawer and at least one shelf, with one or more of the drawer(s) and shelf/shelves being of the pull-out style.

Figure 2:
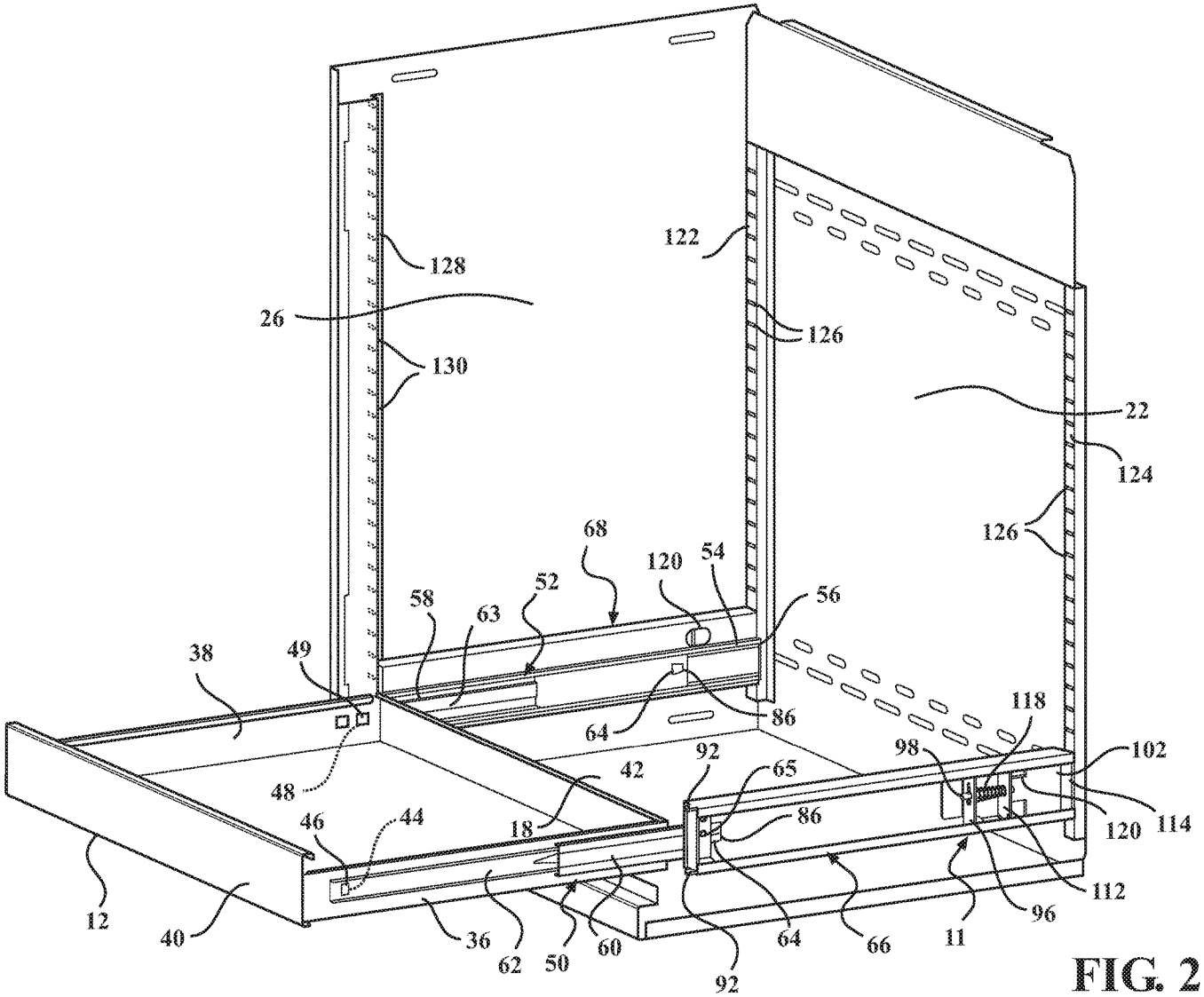
FIG. 2 is a perspective view of a portion of the cabinet assembly including an embodiment of an adjustment mechanism for enabling a user to adjust a height of the pull-out drawer.

As shown in FIG. 2, the drawer 12 has first 36 and second 38 opposing sides extending between forward 40 and rearward 42 drawer ends. The first side 36 of the drawer 12 has a pair of apertures 44 for receiving tabs 46 or other locating devices of a track member 62 of first drawer slide assembly 50. The second side 38 of the drawer 12 has a pair of apertures 48 for receiving tabs 49 or other locating devices of a track member 63 of a second drawer slide assembly 52.

It is to be appreciated that the first 50 and second 52 drawer slide assemblies include similar operational components, although one or more of the components may be arranged differently for attachment to a particular side 36, 38 of the drawer 12. To this end, details of the first 50 and second 52 drawer slide assemblies are therefore described below with reference to the second drawer slide assembly 52 only.

Figure 4:
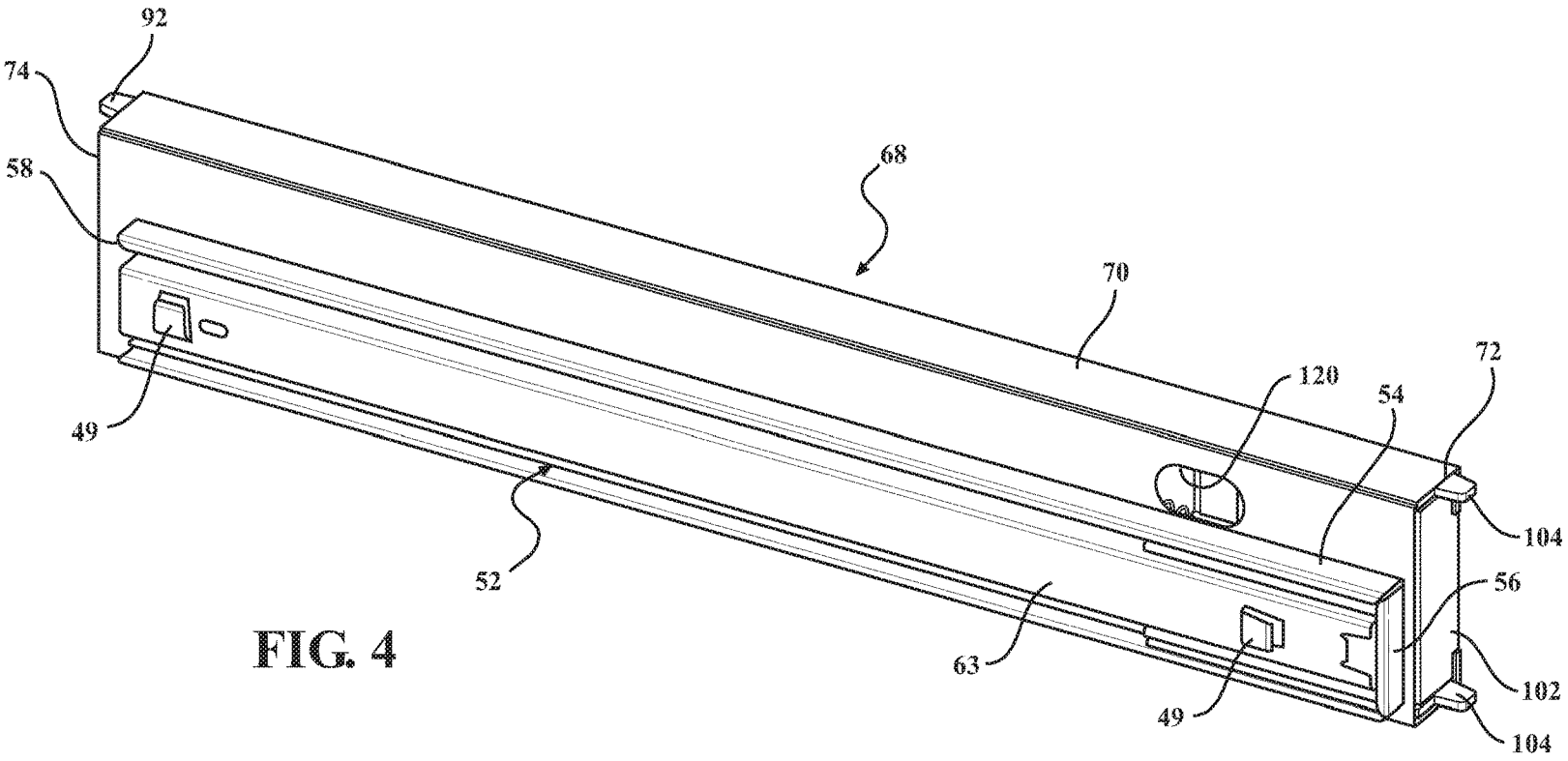
FIG. 4 is a front perspective view of the track mount assembly with a drawer slide assembly coupled to the track mount assembly.
Figure 5:
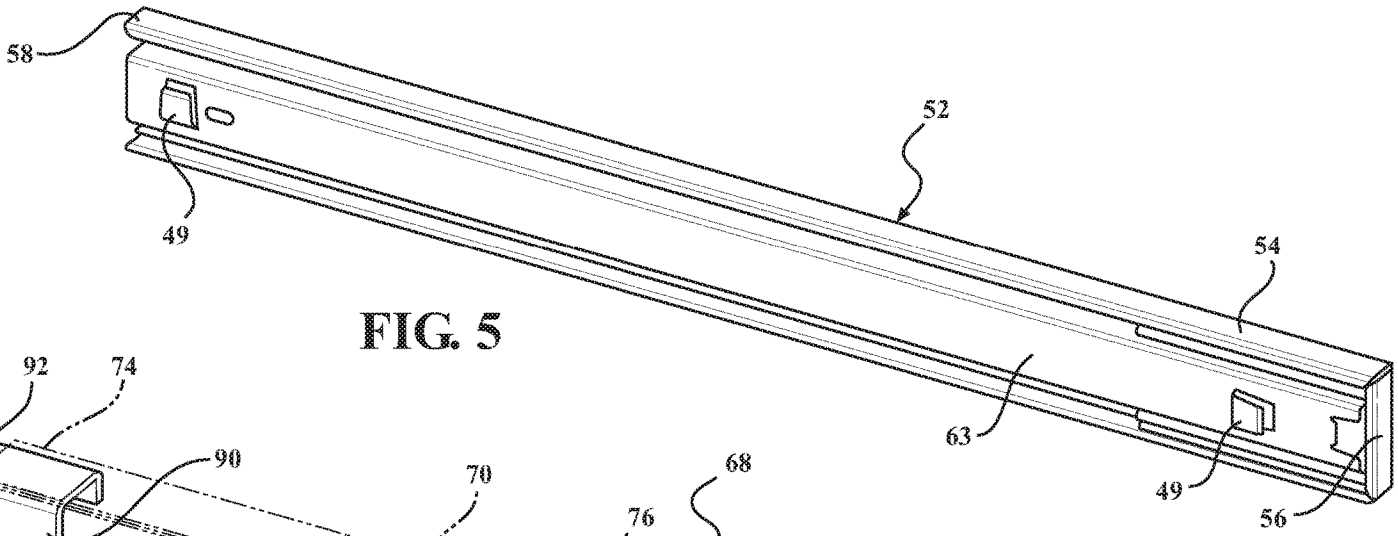
FIG. 5 is a perspective view of one side of the drawer slide assembly.

With reference to FIGS. 2, 4, 5, and 8, the second drawer slide assembly 52 has a base member 54 having rearward 56 and forward 58 ends, a moveable member 60 moveably supported by the base member 54 such that the moveable member 60 (shown in FIG. 2 on the first drawer slide assembly 50) can move relative to the base member 54, and the track member 63 coupled to the moveable member 60. The track member 63 is mounted to the side 38 of the drawer 12. As previously mentioned, the track member 63 includes the tabs 49. As shown in FIGS. 4 and 5, one of the tabs 49 is located about the rearward end 56 of the base member 54 of the second drawer slide assembly 52, and the other tab 49 is located about the forward end 58 of the base member 54 of the second drawer slide assembly 52. The tab 49 located about the rearward end 56 is horizontally arranged, and the tab 49 located about the forward end 58 is vertically arranged. During assembly, the tab 49 about the rearward end 56 (which is horizontally arranged) is inserted into the aperture 48 defined in the drawer side 38 about the rearward drawer end 42. The second drawer slide assembly 52 is then rotated downwardly such that the other tab 49 located at the forward end 58 (which is vertically arranged) is received within the other aperture 48 defined in the drawer side 38 about the forward drawer end 40. The track member 63 may be secured to the drawer side 38 utilizing one or more fasteners.

As previously mentioned, the moveable member 60 is moveably supported by the base member 54 such that the moveable member 60 can move relative to the base member 54. The moveable member 60 also slides along the track member 63 as the drawer 12 is moved between the closed and expanded positions. In a non-limiting example, the movement of the moveable member 60 is accomplished utilizing ball bearings, which enables the moveable member 60 to smoothly and noiselessly slide along the base member 54 and the track member 63 as the drawer 12 is moved between the closed and extended positions. It is to be appreciated that movement of the moveable member 60 may be accomplished utilizing any suitable means.

Figures 7, 8:
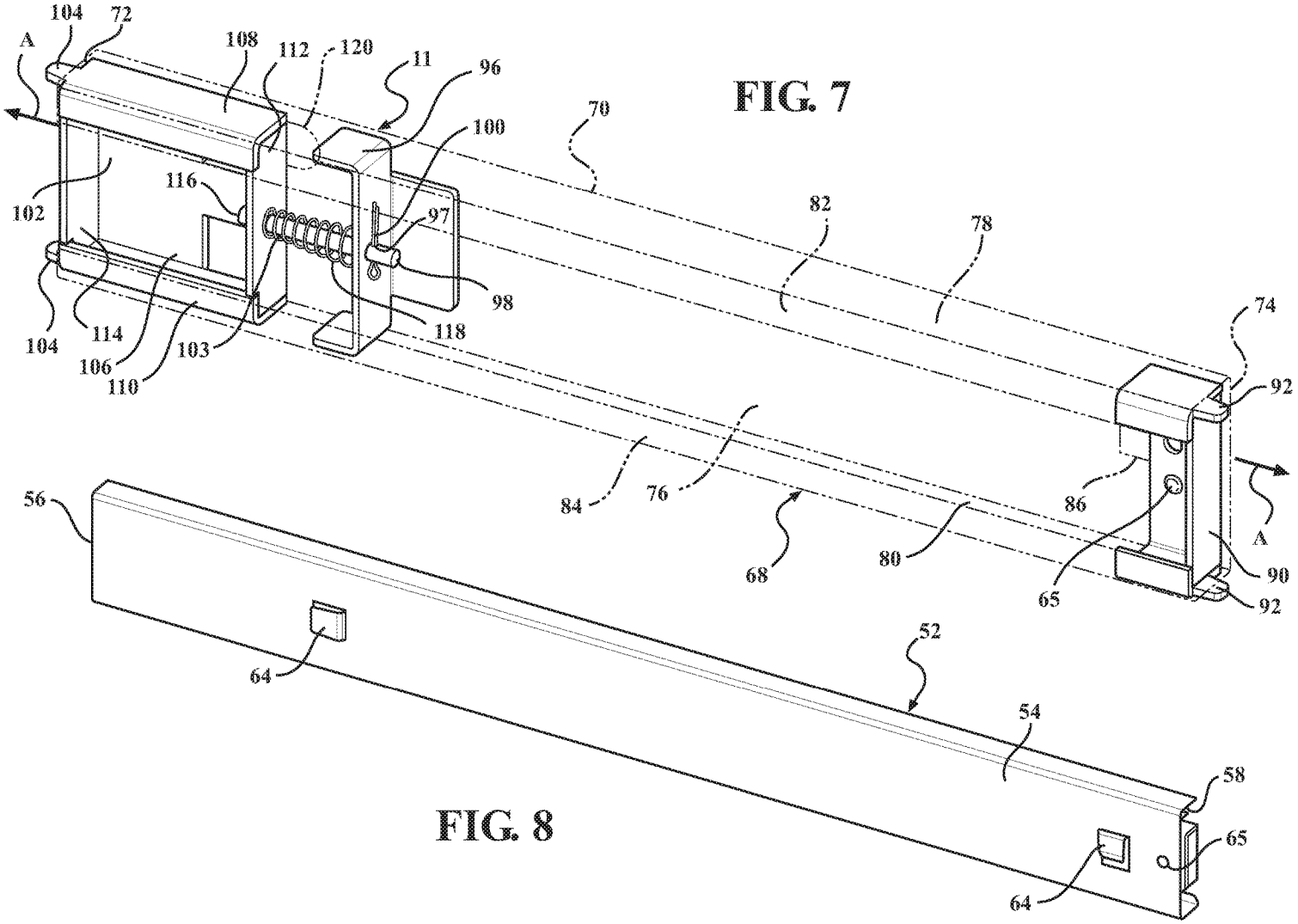
FIG. 7 is a perspective view of another side of the track mount assembly.
FIG. 8 is a perspective view of another side of the drawer slide assembly.

Referring to FIG. 8, the base member 54 of the second drawer slide assembly 52 has tabs 64, with one of the tabs 64 located about the rearward end 56 of the base member 54 of the second drawer slide assembly 52 and the other tab 64 located about the forward end 58 of the base member 54 of the second drawer slide assembly 52. As shown, the tab 64 located about the rearward end 56 is horizontally arranged, and the other tab located about the forward end 58 is vertically arranged. The tabs 64 are adapted to be received in respective apertures 86 defined in the second track mount assembly 68, and the second drawer slide assembly 52 is mounted or permanently fixed to the second track mount assembly 68. In a non-limiting example, the second drawer slide assembly 52 is mounted or permanently fixed to the second track mount assembly 68 utilizing at least one rivet 65.

Referring back to FIG. 2, the cabinet assembly 10 further includes first 66 and second 68 track mount assemblies, with the first track mount assembly 66 mounted to the side 24 of the cabinet 16 and the second track mount assembly 68 mounted to the other side 26 of the cabinet 16. As also shown in FIG. 2, the first drawer slide assembly 50 is mounted to the first track mount assembly 66, and the second drawer slide assembly 52 is mounted to the second track mount assembly 68. It is to be appreciated that the first 66 and second 68 track mount assemblies include similar operational components, although one or more of the components may be arranged differently for attachment to a particular side 24, 26 of the cabinet 16. To this end, details of the first 66 and second 68 track mount assemblies are therefore described below with reference to the second track mount assembly 68 only.

Figure 6:
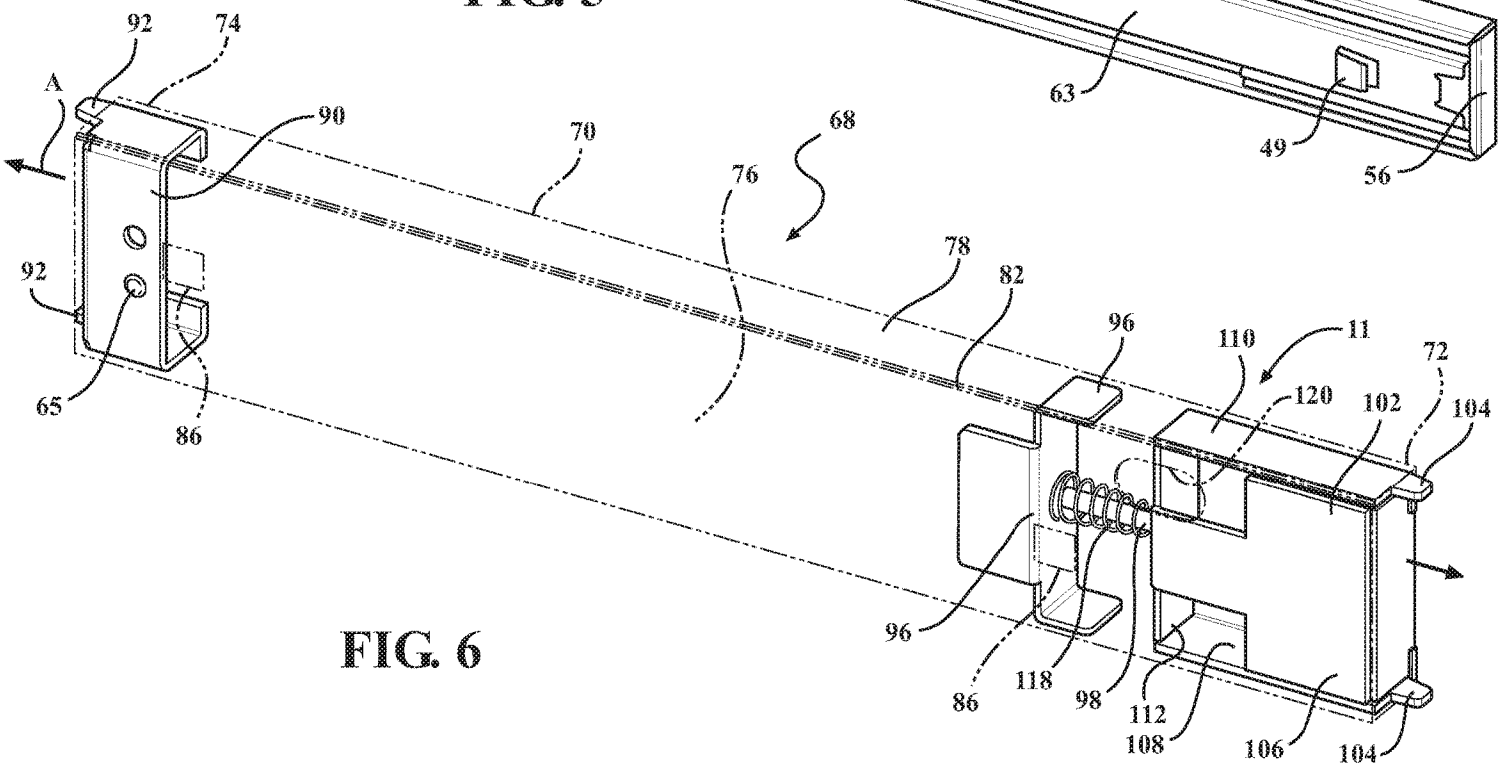
FIG. 6 is a perspective view of one side of the track mount assembly.

As shown at least in FIGS. 6 and 7, the second track mount assembly 68 has a housing 70 defining a longitudinal axis A between rearward 72 and forward 74 housing ends. The housing 70 has a base 76 and sides 78, 80 extending from the base 76. The sides 78, 80 are substantially parallel such that the base 76 and the sides 78, 80 define a substantially C-shaped configuration. Each of the sides 78, 80 has a flange 82, 84, and the flanges 82, 84 extend toward one another.

The base 76 of the housing 70 defines apertures 86, with one of the apertures 86 located about the forward housing end 74 and the other aperture 86 located about the rearward housing end 72, as shown in FIGS. 6 and 7. As previously mentioned, the apertures 86 are adapted to receive the tabs 64 of the second drawer slide assembly 52, and the second drawer slide assembly 52 is mounted to the second track mount assembly 68. For example, the tab 64 located about the rearward housing end 72 (which is horizontally arranged) is slid into the aperture 86 defined in the second track mount assembly 68 about the rearward housing end 72. The second drawer slide assembly 52 is rotated downwardly such that the other tab 64 (which is vertically arranged) is received within the other aperture 86 defined in the second track mount assembly 68 about the forward housing end 74.

In an embodiment, the second track mount assembly 68 has at least one fixed locator 92 (such as a prong, pin, or other suitable extension) extending from the forward housing end 74 in a direction parallel to the longitudinal axis A defined by the housing 70. In the illustrated embodiment, the second track mount assembly 68 has a support 90 disposed within and fixedly mounted to the housing 70 at the forward housing end 74, and the fixed locators 92 are attached or integral with the support 90. In a non-limiting example, the support 90 may be welded to the housing 70. In another non-limiting example, the support 90 may be mounted to the housing 70 utilizing one or more fasteners. As shown, the support 90 has a pair of locators 92 extending from the support 90 beyond the forward housing end 74 and parallel to the longitudinal axis A defined by the housing 70. The locators 92 are adapted to be inserted into slots of a vertical adjustment strip mounted to the cabinet 16, as described in further detail below.

Figure 7A:
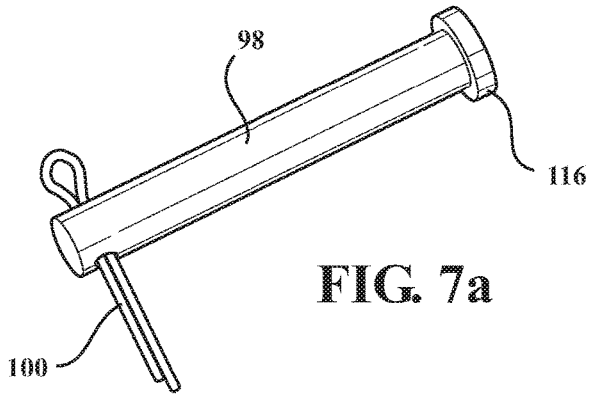
FIG. 7*a* is a perspective view of a post and cotter pin assembly for the track mount assembly.
Figure 9:
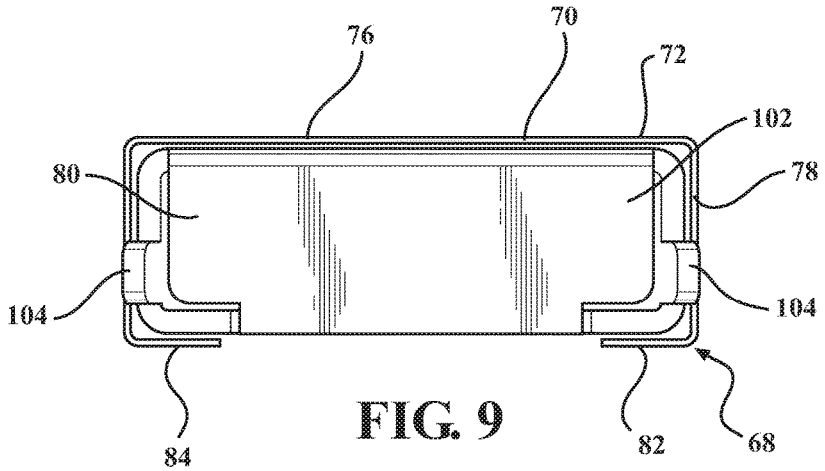
FIG. 9 is an end view of the track mount assembly.
Figure 10:
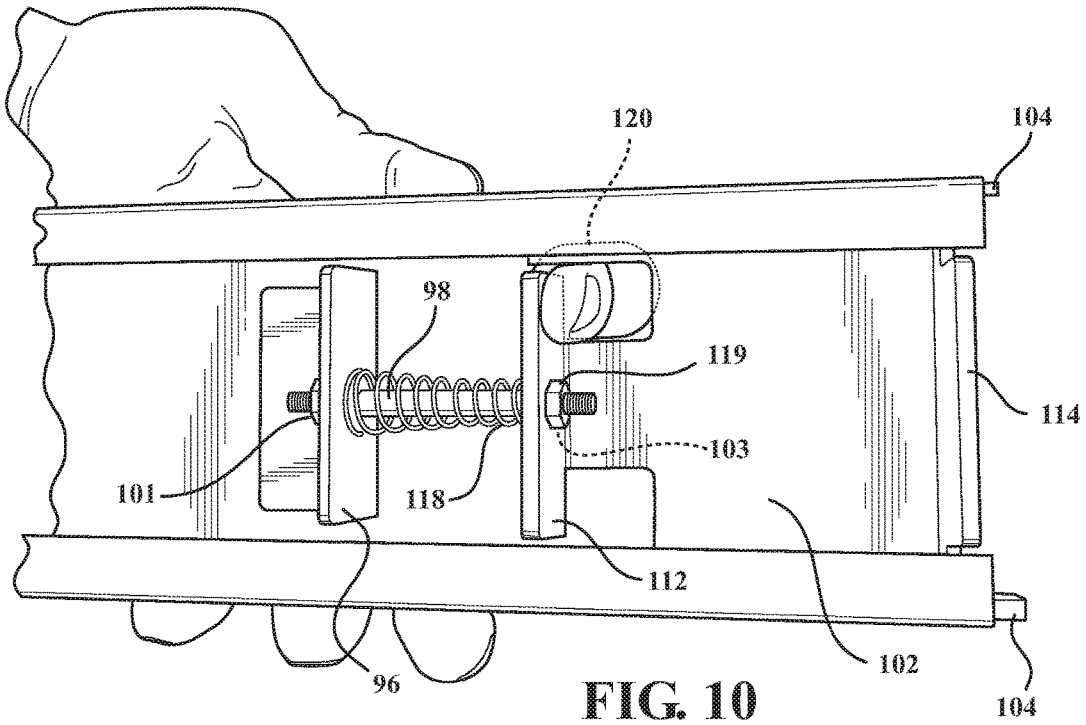
FIG. 10 is side view of a portion of the track mount assembly illustrating adjustment of a moveable insert utilizing the adjustment mechanism.

The second track mount assembly 68 further includes a mount 96 disposed within and fixedly mounted to the housing 70 about the rearward housing end 72. The mount 96 defines an aperture 97, and the second track mount assembly 68 further includes a post 98 disposed through the aperture 97 and secured utilizing a suitable securing device, such as cotter pin 100 (as shown in FIGS. 7 and 7*a*), a nut 101 (as shown in FIG. 10), and/or the like. The second track mount assembly 68 further includes a biasing member 118 disposed on the post 98, which is described in further detail below.

Figure 11:
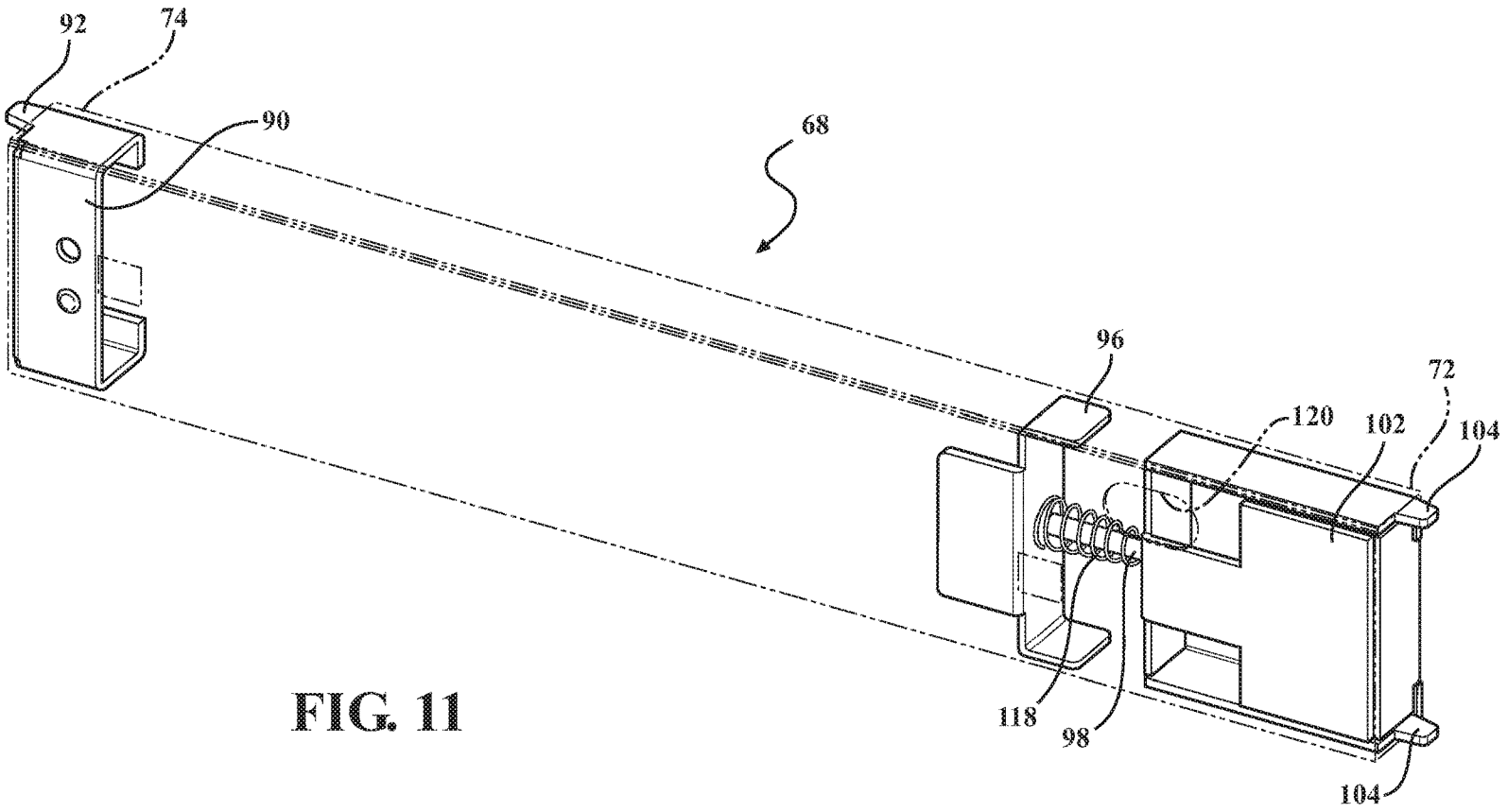
FIG. 11 is a perspective view of the track mount assembly in a protruding position.
Figure 12:
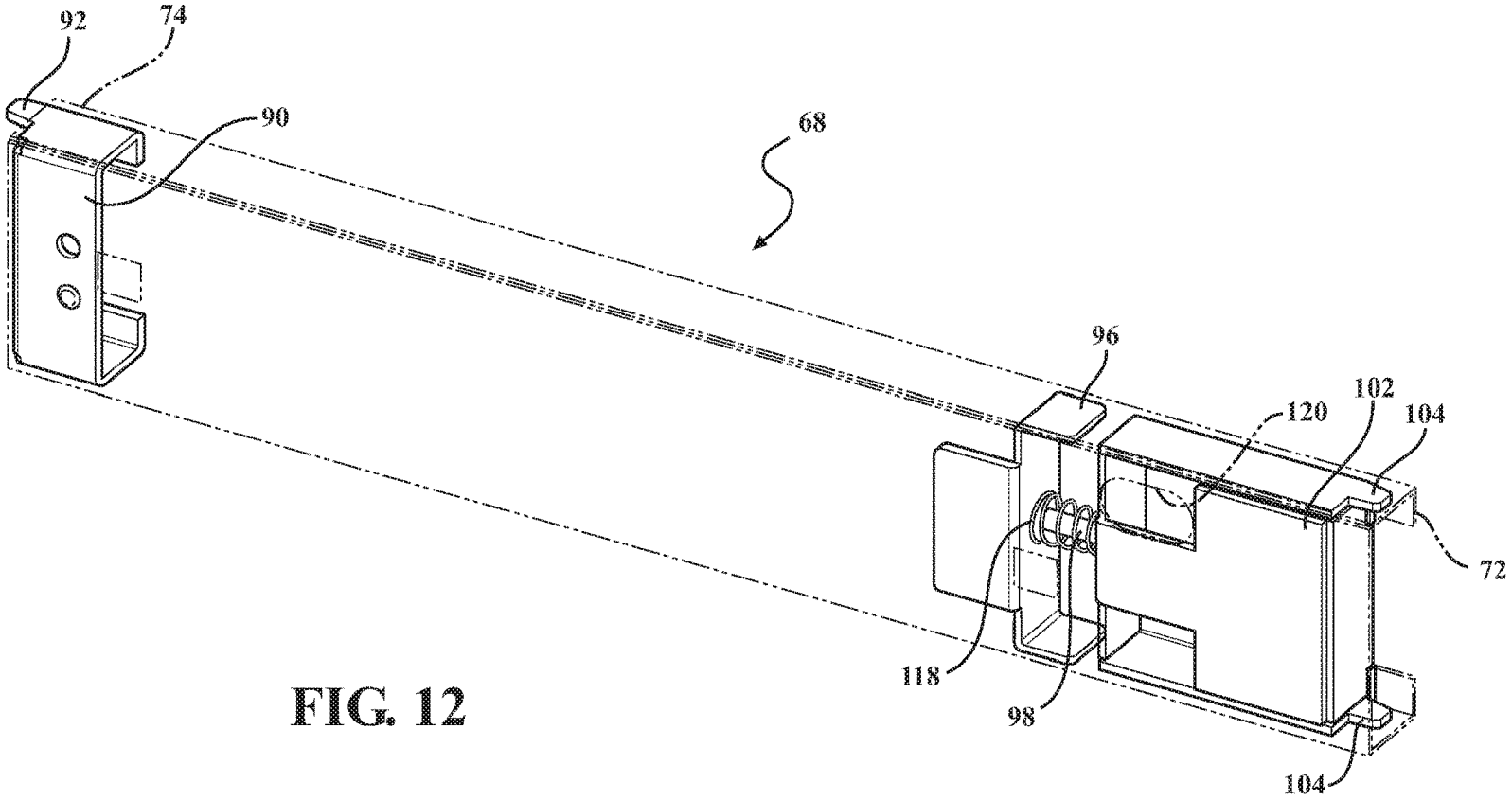
FIG. 12 is a rear perspective view of the track mount assembly in a retracted position.

The second track mount assembly 68 further includes the adjustment mechanism 11, which has at least one moveable locator 104 (such as a prong, pin, or other suitable extension) located about the rearward housing end 72 and extending in a direction parallel to the longitudinal axis A defined by the housing 70. The moveable locator 104 is moveable relative to the housing 70 along the longitudinal axis A between retracted and protruding positions. The moveable locator 104 is biased outwardly and extends from the rearward housing end 72 when in the protruding position (as shown in FIG. 11). The moveable locator 104 is located within the housing 70 when in the retracted position (as shown in FIG. 12). In the embodiment shown, the second track mount assembly 68 has a moveable insert 102 disposed within the housing 70 about the rearward housing end 72, and the moveable insert 102 includes the locator(s) 104. The moveable insert 102 is moveable within the housing 70 along the longitudinal axis A between the retracted and protruding positions. As shown, the moveable insert 102 has a back 106, opposing sides 108, 110, and opposing end plates 112, 114. A pair of locators 104 extends from the moveable insert 102, particularly from each of the opposing sides 108, 110 and parallel to the longitudinal axis A defined by the housing 70. The locators 104 are adapted to be inserted into slots of another vertical adjustment strip mounted to the cabinet 16, as described in further detail below.

As best shown in FIG. 7, the end plate 112 defines an aperture 103 for receiving another end of the post 98. The post 98 may have a head 116 (as shown in FIG. 7*a*), which seats against the surface of the end plate 112. In an alternative embodiment, a nut may be attached to the post 98, and the nut may be seated against the surface of the end plate 112 as shown in FIG. 10. The second track mount assembly 68 further includes the biasing member 118, such as a compression spring, disposed on the post 98 between the mount 96 and the moveable insert 102. The biasing member 118 biases the moveable insert 102 outwardly toward the protruding position, where the locator(s) 104 extends beyond the rearward housing end 74 and is exposed outside of the second track mount assembly 68126.

The housing 70 of the second track mount assembly 68 further defines an access 120, such as an opening having any suitable configuration, adjacent the end plate 112 of the moveable insert 102. During adjustment of a drawer 12 height, an operator can insert his/her finger into the access 120 and contact the end plate 112 of the moveable insert 102. This is illustrated in FIG. 10. When pressure is applied to the end plate 112, the moveable insert 102 is moved along the longitudinal axis A of the housing 70 inwardly (for example, in a direction opposite the biasing direction of the biasing member 118) to compress the biasing member 118 and move the locator(s) 104 to the retracted position, as shown in FIG. 12. When moved (or retracted), the locator(s) 104 is positioned within the housing 70. When the operator releases pressure on the end plate 112, the biasing member 118 expands and the moveable insert 102 is moved outwardly along the longitudinal axis A along the biasing direction to extend the locator(s) 104 and into the protruding position, as shown in FIG. 11.

Figure 3:
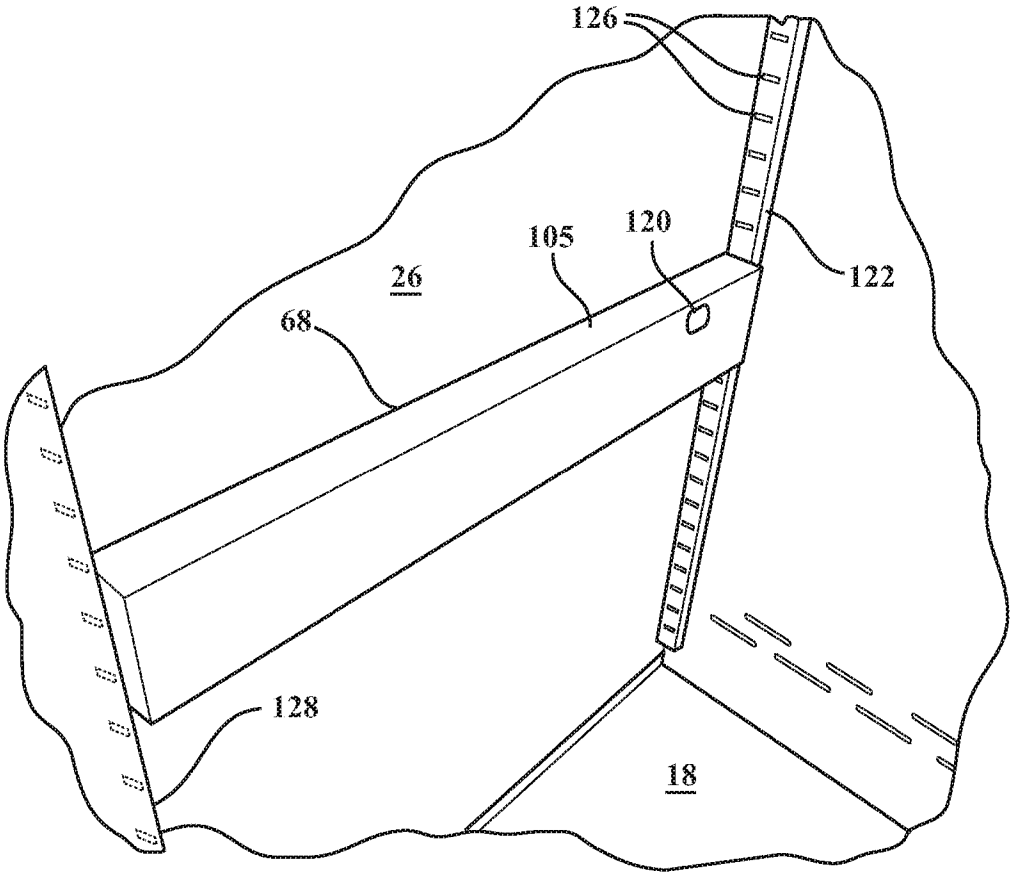
FIG. 3 is front perspective view of a track mount assembly including the adjustment mechanism.

In an embodiment, and as shown in FIG. 3, the second track mount assembly 68 may further include another aperture 105 for receiving a toggle switch as a locking mechanism (not shown). The toggle switch may be used to lock the first track mount assembly 66 in the protruding position.

As shown at least in FIGS. 2 and 3, the cabinet assembly 10 further has first 122 and third 124 vertical adjustment strips mounted to the back 22 of the cabinet 16, with the first adjustment strip 122 adjacent the side 26 of the cabinet 16 and the third adjustment strip 124 adjacent the other side 24 of the cabinet 16. The first adjustment strip 122 is in contact with the side 26, and although not specifically shown, the second adjustment strip 124 is in contact with the other side 24. Each of the adjustment strips 122, 124 has a plurality of slots 126 aligned vertically along the strips 122, 124, and the slots 126 face forward; i.e., toward the opening 32 of the cavity 30. Each slot 126 is spaced from an adjacent slot 126. In one embodiment, each slot 126 is spaced from about 0.8 to 1.2 inches from an adjacent slot 126. In another embodiment, each slot 126 is spaced about 1 inch from an adjacent slot 126. In alternative embodiments, as opposed to being mounted to the back 22 of the cabinet, the first 122 and third 124 vertical adjustment strips may be mounted to the respective sides 26, 24 of the cabinet 16 at a position adjacent to the back 22.

As shown in FIG. 2, the cabinet assembly 10 further includes a second adjustment strip 128 adjacent the side 26 of the cabinet 16 and opposite the first adjustment strip 122. Although not specifically shown in the figures, the cabinet assembly 10 also includes a fourth adjustment strip adjacent the side 24 of the cabinet and opposite the third adjustment strip 124. Each of the second adjustment strip 128 and the fourth adjustment strip has a plurality of slots 126 aligned vertically along the third adjustment strip 128 and the fourth adjustment strip, and the slots 126 face rearward; i.e., toward the back 22 of the cabinet 16. In addition, each slot 126 of the second adjustment strip 128 is aligned with a respective slot 126 of the first adjustment strip 122. Likewise, each slot of the fourth adjustment strip is aligned with a respective slot 126 of the third adjustment strip 124.

Figure 13:
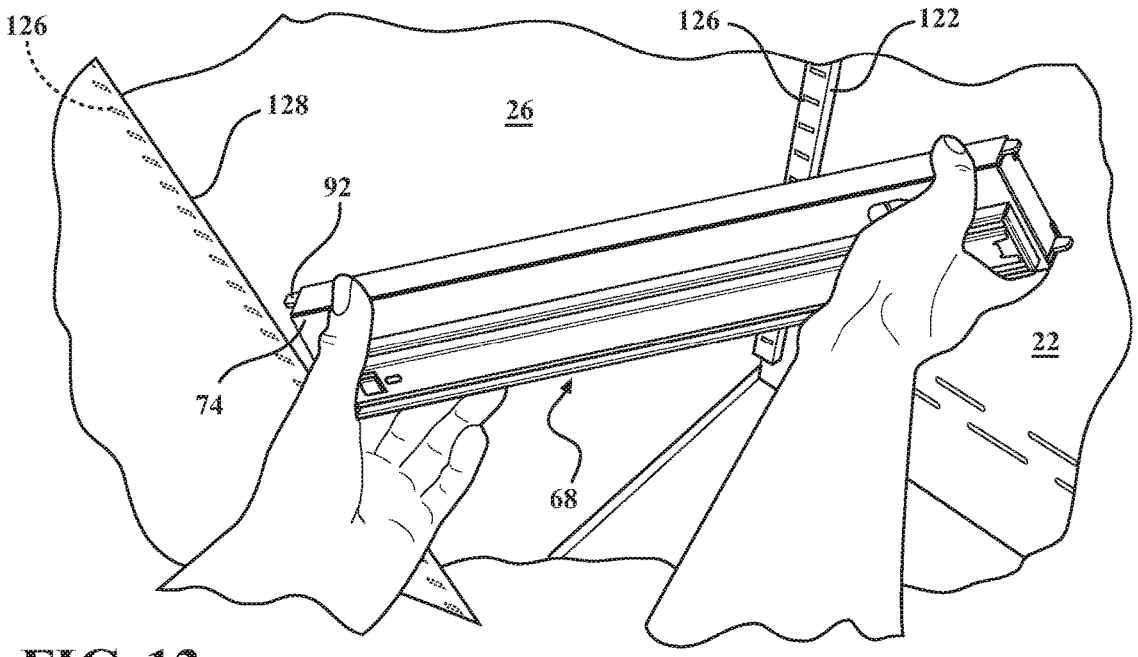
FIGS. 13-14 illustrate steps of a process of coupling the track mount assembly to the cabinet for adjusting a height of the pull-out drawer of the cabinet assembly.

Adjustment of the drawer 12 height of the cabinet assembly 10 is described below at least with reference to FIGS. 10-14. With the drawer 12 removed from the cabinet 16, the track mount assemblies 66, 68 are mounted or secured to the sides 24, 26 of the cabinet 16 at an operator-selected drawer height. For example, FIG. 13 illustrates attachment of the second track mount assembly 68 to the side 26 of the cabinet 16. An operator can position the forward housing end 74 of the side mount assembly 68 such that the locator(s) 92 of the support 90 is aligned with respective selected slot(s) 126 defined in the second adjustment strip 128. Once aligned, the operator can insert the locator(s) 92 into the slot(s) 126 to secure the forward housing end 74 to the cabinet 16.

Figure 14:
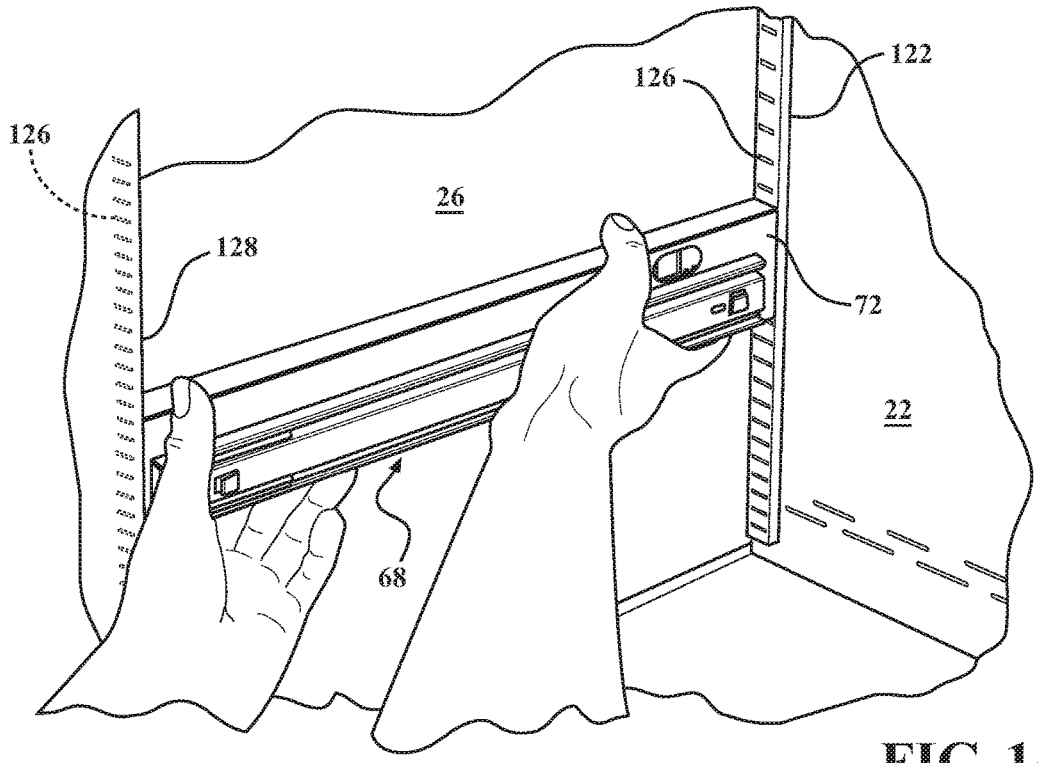

Then, the operator inserts his/her finger or other suitable device into the access 120 defined in the housing 70 (such as shown in FIG. 10), and applies pressure to the end plate 112 of the moveable insert 102 to compress the biasing member 118 and move the moveable insert 102 to the retracted position (again, shown in FIG. 12). With the first track mount assembly 66 in the retracted position, and as shown in FIG. 14, the operator rotates the first track mount assembly 66 to position the rearward housing end 72 adjacent the first vertical adjustment strip 122 such that the locator(s) 104 is aligned with selected slot(s) 126 defined in the first vertical adjustment strip 122.

Upon releasing pressure from the end plate 112, the biasing member 118 expands and moves the moveable insert 102 outwardly toward rearward housing end 72 and into the protruding position (again, as shown in FIG. 11). When in the protruding position, the locator(s) 104 extends beyond the rearward housing end 72 and snaps into the selected slot(s) 126 defined in the first vertical adjustment strip 122 to secure the second track mount assembly 68 to the cabinet 16.

The same procedure above may be followed for coupling the first track mount assembly 66 to the other side 24 of the cabinet 16. Typically, the track mount assemblies 66, 68 are mounted so that the track mount assemblies 66, 68 lie within the same horizontal plane. In this way, the drawer 12 which is subsequently attached to the track mount assemblies 66, 68 is level.

Once the track mount assemblies 66, 68 are secured to the cabinet 16, the drawer 16 can be installed as previously described by coupling the drawer slide assemblies 50, 52 with the respective sides 36, 38 of the drawer 12.

In alternative embodiments, the cabinet 16 of the cabinet assembly 10 includes the opposing sides 24, 26 as described above, but does not include one or more of the back 22, bottom 18, or top 28. Accordingly, in these embodiments, the cabinet assembly 10 takes on the form of a racking assembly or any other structure not specifically enclosed to define a cavity that includes the drawer 16 supported therein.

In these alternative embodiments, the first, second, third and fourth adjustment strips 122, 124, 128 are mounted to the opposing sides 24, 26 in a manner similar to what is described and illustrated above, with the second adjustment strips 128 opposite the first adjustment strip 122 along side 26 and the fourth adjustment strip opposite the second adjustment strip 124 along side 24. The first and second track mounting assemblies 66, 68 and drawers 12 (including the drawer slide assemblies 50, 52) can be installed in the manner described above to complete the cabinet assembly 10.

The invention has been described in an illustrative manner, and it is be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

The invention claimed is:

1. A cabinet assembly comprising:

a cabinet having a first side and an opposing second side;

first and second adjustment strips coupled adjacent to said first side of said cabinet, each of said first and second adjustment strips including a plurality of slots aligned vertically along said first and second adjustment strips;

a first track mount assembly adjustably mounted to each of said first and second adjustment strips along said first side of said cabinet, said first track mount assembly comprising:

a housing having a rearward housing end and a forward housing end;

at least one fixed locater positioned at said forward housing end, wherein each one of said at least one fixed locaters is coupled within a respective one of said plurality of slots of said first adjustment strip; and an adjustment mechanism coupled to said housing at said rearward housing end, said adjustment mechanism comprising:

a moveable insert disposed within said housing and moveable relative to said rearward housing end between an engaged position and an adjustment position, at least one locater coupled to said moveable insert, a biasing device coupled to said moveable insert and biasing said moveable insert in a biasing direction such that said at least one locater is extended beyond said rearward housing end of said housing when said moveable insert is in said engaged position, wherein each one of said at least one locaters is coupled within a respective one of said plurality of slots of said second adjustment strip when said moveable insert is in said engaged position;

third and fourth adjustment strips coupled adjacent to said second side of said cabinet, each of said third and fourth adjustment strips including a plurality of slots aligned vertically along said third and fourth adjustment strips; and a second track mount assembly adjustably mounted to each of said third and fourth adjustment strips along said second side of said cabinet, said second track mount assembly comprising:

a housing having a rearward housing end and a forward housing end;

at least one fixed locater extending from said forward housing end, wherein each one of said at least one fixed locaters is coupled within a respective one of said plurality of slots of said third adjustment strip; and an adjustment mechanism coupled to said housing at said rearward housing end, said adjustment mechanism comprising:

a moveable insert disposed within said housing and moveable relative to said rearward housing end between an engaged position and an adjustment position, at least one locater coupled to said moveable insert, a biasing device coupled to said moveable insert and biasing said moveable insert in a biasing direction such that said at least one locater is extended beyond said rearward housing end of said housing when said moveable insert is in said engaged position, wherein each one of said at least one locaters is coupled within a respective one of said plurality of slots of said fourth adjustment strip when said moveable insert is in said engaged position.

2. The cabinet assembly of claim 1, wherein said cabinet further has a back, a top and a bottom that collectively with said first and second sides define a cavity having an opening.

3. The cabinet assembly of claim 2, wherein said first adjustment strip and third adjustment strip are each respectively adjacent said back of said cabinet within said cavity.

4. The cabinet assembly of claim 2, wherein said first adjustment strip and fourth adjustment strip are each respectively adjacent said back of said cabinet within said cavity.

5. The cabinet assembly of claim 2, wherein said second adjustment strip and fourth adjustment strip are each respectively adjacent said back of said cabinet within said cavity.

6. The cabinet assembly of claim 1, wherein said first track mount assembly further comprises a support fixedly mounted to said housing at said forward housing end, wherein said at least one fixed locater is coupled to said support.

7. The cabinet assembly of claim 6, wherein said second track mount assembly further comprises a support fixedly mounted to said housing at said forward housing end, wherein said at least one fixed locater is coupled to said support.

8. The cabinet assembly of claim 1, wherein said first track mount assembly further comprises a mount fixedly coupled to said housing, said mount defining a first aperture.

9. The cabinet assembly of claim 8, wherein said second track mount assembly further comprises a mount fixedly coupled to said housing, said mount defining a first aperture.

10. The cabinet assembly of claim 1, wherein said moveable insert of said first track mount assembly includes:

a pair of opposing end plates spaced apart such that a first one of said pair of opposing end plates is disposed between forward housing end and said second one of said pair of opposing end plates, said first one of said pair of opposing end plates defining a second aperture; and.

a post having a first end received within said first aperture and a second end received within said second aperture, said post secured to said mount and said moveable insert.

11. The cabinet assembly of claim 10, wherein said moveable insert of said second track mount assembly includes:

a pair of opposing end plates spaced apart such that a first one of said pair of opposing end plates is disposed between forward housing end and said second one of said pair of opposing end plates, said first one of said pair of opposing end plates defining a second aperture; and.

a post having a first end received within said first aperture and a second end received within said second aperture, said post secured to said mount and said moveable insert.

12. The cabinet assembly of claim 11, wherein said housing of each of said first and second track mount assemblies comprises:

a base having a first surface and an opposing second surface, said base extending from said rearward housing end to said forward housing end; and a pair of parallel sides extending from opposite ends of said first surface of said said base, wherein said pair of parallel sides and said base define a substantially c-shaped configuration, wherein said moveable insert is positioned along said first surface of said base and within said c-shaped configuration, and wherein said base defines an access extending from said opposing second surface to said first surface, said access positioned along said base adjacent to said first one of said end plates of said moveable insert and configured to allow access for applying a force to said first one of said end plates of said moveable insert in a direction towards said forward housing end such that said moveable insert moves along said longitudinal axis towards said fixed mount to compress said biasing device and to move said at least one locater from said engaged position to said adjustment position such that said at least one locater is not extended beyond said rearward housing end of said housing.

13. The cabinet assembly of claim 10, wherein said housing of said first track mount assembly comprises:

a base having a first surface and an opposing second surface and extending from said rearward housing end to said forward housing end; and a pair of parallel sides extending from opposite ends of said first surface of said said base, wherein said pair of parallel sides and said base define a substantially c-shaped configuration, wherein said moveable insert is positioned along said first surface of said base and within said c-shaped configuration, and wherein said base defines an access extending from said opposing second surface to said first surface, said access positioned along said base adjacent to said first one of said end plates of said moveable insert and configured to allow access for applying a force to said first one of said end plates of said moveable insert in a direction towards said forward housing end such that said moveable insert moves along said longitudinal axis towards said fixed mount to compress said biasing member and to move said at least one locater from said engaged position to said adjustment position such that said at least one locater is not extended beyond said rearward housing end of said housing.

14. The cabinet assembly of claim 13 further comprising:

a drawer including a forward end, a rearward end, a right side and a left side each respectively extending between said forward and rearward ends;

a first drawer slide assembly coupled to said right side of said drawer and also coupled to said first track mount assembly; and a second drawer slide assembly coupled to said left side of said drawer and also coupled to said second track mount assembly, wherein said drawer is configured such that said drawer is slidably engaged with said first track mount assembly through said first drawer slide assembly and wherein said drawer is also slidably engaged with said second mount assembly through said second drawer slide assembly when said drawer is coupled to each of said first and second track mount assemblies.

15. The cabinet assembly of claim 14, wherein said first drawer slide assembly comprises:

a base member coupled to said opposing second surface of said base of said first track mount assembly;

a moveable member movably supported by said base member such that said moveable member can move relative to said base member; and a track member mounted to one of said opposing sides of said drawer and coupled to said moveable member.

16. The cabinet assembly of claim 14, wherein said second drawer slide assembly comprises:

a base member coupled to said opposing second surface of said base of said second track mount assembly;

a moveable member movably supported by said base member such that said moveable member can move relative to said base member; and a track member mounted to one of said opposing sides of said drawer and coupled to said moveable member.

17. A method for installing a drawer within a cabinet of a cabinet door assembly, said method comprising:

(a) providing the cabinet door assembly comprising:

a cabinet having a first side and an opposing second side;

first and second adjustment strips coupled adjacent to said first side of said cabinet, each of said first and second adjustment strips including a plurality of slots aligned vertically along said first and second adjustment strips;

third and fourth adjustment strips coupled adjacent to said second side of said cabinet, each of said third and fourth adjustment strips including a plurality of slots aligned vertically along said third and fourth adjustment strips;

(b) providing a first track mount assembly and a second track mount assembly each comprising:

a housing having a rearward housing end and a forward housing end;

at least one fixed locater extending from said forward housing end; and an adjustment mechanism coupled to said housing at said rearward housing end, said adjustment mechanism comprising:

a moveable insert disposed within said housing and moveable relative to said rearward housing end between an engaged position and an adjustment position, at least one locater coupled to said moveable insert, a biasing device coupled to said moveable insert for biasing the moveable insert in an engaged position;

(c) coupling the first track mount assembly to the first and second adjustment strip by:

inserting a respective one of the at least one fixed locater of the first track mount assembly within a corresponding one of the plurality of slots of the first adjustment strip;

applying a force to move the moveable insert of the first track mount assembly from the engaged position to the adjustment position such that the at least one locater does not extend beyond the rearward housing end of the housing;

aligning the first track mount assembly relative to the second adjustment strip such that the at least one locater of the first track mount assembly is aligned with a corresponding one of the plurality of slots of the second adjustment strip;

releasing the force to return the moveable insert of the first track mount assembly to the engaged position such that the at least one locater is positioned within the corresponding one of the plurality of slots of the other one of the first or second adjustment strip;

(d) coupling the second track mount assembly to the third and fourth adjustment strip by:

inserting a respective one of the at least one fixed locater of the second track mount assembly within a corresponding one of the plurality of slots of the third adjustment strip;

applying a force to move the moveable insert of from the engaged position to the adjustment position such that the at least one locater does not extend beyond the rearward housing end of the housing;

aligning the second track mount assembly relative to the fourth adjustment strip such that the at least one locater is aligned with a corresponding one of the plurality of slots of the fourth adjustment strip;

releasing the force to return the moveable insert of the second track mount assembly to the engaged position such that the at least one locater is positioned within the corresponding one of the plurality of slots of the fourth adjustment strip;

(e) providing a drawer including a forward end, a rearward end, a right side and a left side each respectively extending between the forward and rearward ends; and (f) installing the drawer at a first position within the cabinet by:

coupling a first drawer slide assembly to the right side of the drawer and to the first track mount assembly and coupling a second drawer assembly to the left side of the drawer and to the second track mount assembly;

inserting the drawer between the first side and the second side such that the drawer is slidably engaged with the first mount assembly through the first drawer slide assembly and such that the drawer slidably engaged with the second mount assembly through the second drawer slide assembly.

18. The method of claim 17, wherein the housing of each respective one of the first and second track mount assembly comprises:

a base having a first surface and an opposing second surface, the base extending from the rearward housing end to the forward housing end, the base defining an access extending from the opposing second surface to the first surface, the access positioned along the base adjacent to the first one of the end plates of the moveable insert, and wherein the step of (c) coupling the first track mount assembly to the first and second adjustment strip comprises:

inserting a respective one of the at least one fixed locater of the first track mount assembly within a corresponding one of the plurality of slots of the adjustment strip;

accessing the moveable insert through the access of the moveable insert of the first track mount assembly and pushing the moveable insert in a direction along the longitudinal axis towards the fixed mount to compress the biasing member, thereby moving the at least one locater to the retracted position such that the locater is not extended beyond the rearward housing end of the housing;

aligning the first track mount assembly such that the at least one locater is aligned with a corresponding one of the plurality of slots of the second adjustment strip; and releasing the force to return the moveable insert to the protruding position such that the at least one locater is positioned within the corresponding one of the plurality of slots of the second adjustment strip.

19. The method of claim 18, wherein the step of (d) coupling the second track mount assembly to the third and fourth adjustment strip comprises:

inserting a respective one of the at least one fixed locater of the second track mount assembly within a corresponding one of the plurality of slots of the third adjustment strip;

accessing the moveable insert through the access of the moveable insert of the second track mount assembly and pushing the moveable insert in a direction along the longitudinal axis towards the fixed mount to compress the biasing member, thereby moving the at least one locater to the retracted position such that the locater is not extended beyond the rearward housing end of the housing;

aligning the second track mount assembly such that the at least one locater is aligned with a corresponding one of the plurality of slots of the fourth adjustment strip; and releasing the force to return the moveable insert to the protruding position such that the at least one locater is positioned within the corresponding one of the plurality of slots of the fourth adjustment strip.

20. The method of claim 17 further comprising (g) adjusting the positioning of the drawer from the first position to a second position by:

removing the drawer from the cabinet;

uncoupling the first track mount assembly from the first and third adjustment strip by:

applying a force to move the moveable insert of the first track mount assembly along the longitudinal axis towards the mount from the protruding position to the retracted position such that the at least one locater does not extend beyond the rearward housing end of the housing and within the one of the plurality of slots of the second adjustment strip;

moving the first track mount assembly relative to the first adjustment strip such that the at least one locater of the first track mount assembly is not aligned with a corresponding one of the plurality of slots of the second adjustment strip; and removing the respective one of the at least one fixed locater of the first track mount assembly from the corresponding one of the plurality of slots of the first adjustment strip;

(i) uncoupling the second track mount assembly from the first and third adjustment strip by:

applying a force to move the moveable insert of the second track mount assembly along the longitudinal axis towards the mount from the protruding position to the retracted position such that the at least one locater does not extend beyond the rearward housing end of the housing and within the one of the plurality of slots of the fourth adjustment strip;

moving the second track mount assembly relative to the fourth adjustment strip such that the at least one locater of the first track mount assembly is not aligned with a corresponding one of the plurality of slots of the fourth adjustment strip; and removing the respective one of the at least one fixed locater of the second track mount assembly from the corresponding one of the plurality of slots of the third adjustment strip;

(j) recoupling the first track mount assembly to the first and second adjustment strip by:

inserting a respective one of the at least one fixed locater of the first track mount assembly within a corresponding another one of the plurality of slots of the first adjustment strip;

aligning the first track mount assembly relative to the second adjustment strip such that the at least one locater of the first track mount assembly is aligned with a corresponding another one of the plurality of slots of the second adjustment strip;

releasing the force to return the moveable insert of the first track mount assembly to the protruding position such that the at least one locater is positioned within the corresponding another one of the plurality of slots of the second adjustment strip;

(k) recoupling the second track mount assembly to the third and fourth adjustment strip by:

inserting a respective one of the at least one fixed locater of the second track mount assembly within a corresponding another one of the plurality of slots of one of the third adjustment strip;

aligning the second track mount assembly relative to the fourth adjustment strip such that the at least one locater is aligned with a corresponding another one of the plurality of slots of the fourth adjustment strip;

releasing the force to return the moveable insert of the second track mount assembly to the protruding position such that the at least one locater is positioned within the corresponding another one of the plurality of slots of the fourth adjustment strip; and (l) reinstalling the drawer at the second position within the cabinet such that the drawer is slidably engaged with the first mount assembly through the first slide assembly and is slidably engaged with the second mount assembly through the second slide assembly when the drawer is moved between the closed position and the extended position.

* * * * *